US010197963B2

(12) United States Patent
Watanabe

(10) Patent No.: US 10,197,963 B2
(45) Date of Patent: Feb. 5, 2019

(54) IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventor: Takeshi Watanabe, Yokohama Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/920,351

(22) Filed: Mar. 13, 2018

(65) Prior Publication Data

US 2018/0203397 A1 Jul. 19, 2018

Related U.S. Application Data

(63) Continuation of application No. 15/657,557, filed on Jul. 24, 2017, now Pat. No. 9,952,546.

(30) Foreign Application Priority Data

Sep. 6, 2016 (JP) ..... 2016-173799

(51) Int. Cl.

| | |
|---|---|
| ***G03G 15/00*** | (2006.01) |
| *G03G 21/14* | (2006.01) |
| *G07D 7/01* | (2016.01) |

(52) U.S. Cl.

CPC ..... *G03G 15/6529* (2013.01); *G03G 15/5012* (2013.01); *G03G 15/6538* (2013.01); *G03G 15/5029* (2013.01); *G03G 15/55* (2013.01); *G03G 15/6591* (2013.01); *G03G 21/14* (2013.01); *G03G 2215/00518* (2013.01); *G07D 7/01* (2017.05)

(58) Field of Classification Search

CPC ..... G03G 15/6529; G03G 15/6538

See application file for complete search history.

(56) References Cited

U.S. PATENT DOCUMENTS

| | | | |
|---|---|---|---|
| 8,054,484 | B2 | 11/2011 | Hosokawa |
| 2008/0309979 | A1 | 12/2008 | Honda |
| 2010/0208292 | A1 | 8/2010 | Tomono |
| 2010/0214592 | A1 | 8/2010 | Muroi |

OTHER PUBLICATIONS

Extended European Search Report filed Jan. 19, 2018 in counterpart European Patent Application No. 17187503.2 (6 pages).

*Primary Examiner* — Erika J Villaluna

(74) *Attorney, Agent, or Firm* — Patterson & Sheridan, LLP

(57) ABSTRACT

According to the embodiment, an image forming apparatus includes an image forming unit, a writing unit, and a processor. The processor forms a first image again on a third sheet, when the writing unit does not succeed in writing information in a wireless tag of a first sheet, on which the first image is formed by the image forming unit. Further, the processor discharges the third sheet prior to a second sheet, on which a second image is formed, the second image being next to the first image.

10 Claims, 9 Drawing Sheets

IMAGE FORMING APPARATUS

CROSS-REFERENCE TO RELATED APPLICATIONS

This application is a continuation of U.S. patent application Ser. No. 15/657,557, filed on Jul. 24, 2017, which is based upon and claims the benefit of priority from the prior Japanese Patent Application No. 2016-173799, filed on Sep. 6, 2016, the entire contents of each of which are incorporated herein by reference.

FIELD

An embodiment to be described here generally relates to an image forming apparatus.

BACKGROUND

Sheets with wireless tags (RF (Radio Frequency) tags) are known. An apparatus that forms an image on a sheet with a wireless tag by using an electrophotographic method, writes information in the wireless tag, and reads information from the wireless tag, is known.

A wireless tag may sometimes be broken since, in the electrophotographic method, a fixing unit for fixing a toner image heats and presses the wireless tag. A sheet with the broken wireless tag is discharged to a dedicated tray for sheets with broken wireless tags. Accordingly, when images of a plurality of pages are formed on a plurality of sheets, a page is skipped in the sheets discharged to a normal tray if a wireless tag is broken.

Further, when an image, which is formed on the sheet with the broken wireless tag, is formed again on a new sheet and the new sheet is discharged to the normal tray, the page sequence of the sheets discharged to the normal tray is disordered. For example, it is assumed that the image of the 2nd page is formed on a sheet, the wireless tag of this sheet is broken, the image of the 3rd page is formed on a sheet, the wireless tag of this sheet is unbroken, and this sheet with the unbroken wireless tag is discharged to the normal tray. Then, since the wireless tag of the sheet, on which the image of the 2nd page is formed, is broken, the image of the 2nd page is formed again on a new sheet, and the new sheet is discharged. As a result, the sheet on which the image of the 1st page is formed, the sheet on which the image of the 3rd page is formed, and the sheet on which the image of the 2nd page is formed are stacked in this order on the normal tray.

As described above, in the prior art, a page is skipped in the sheets discharged to a normal tray, and the page sequence is disordered.

DETAILED DESCRIPTION

Figure 1:
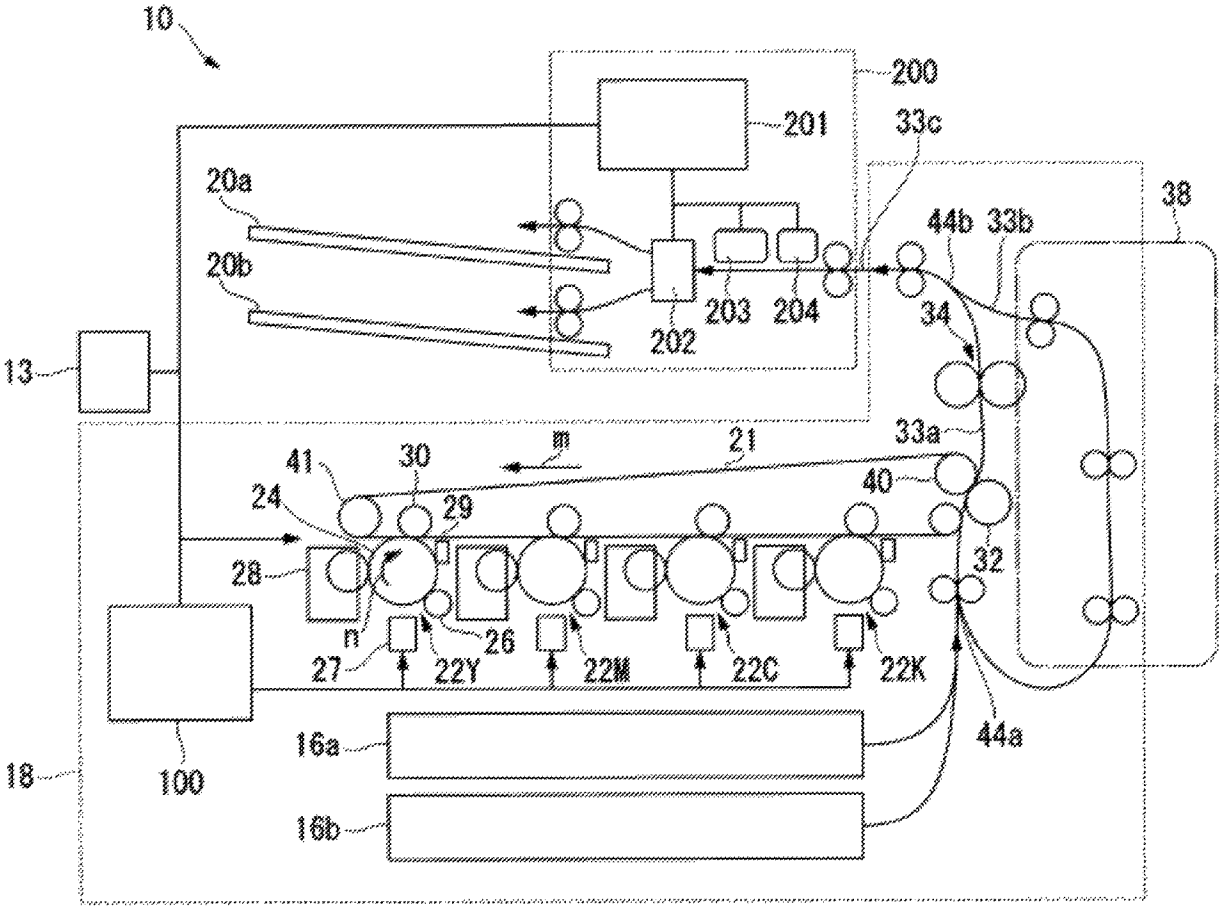
FIG. 1 is a side view showing an image forming apparatus of an embodiment.

According to an embodiment, an image forming apparatus includes an image forming unit, a writing unit, and a processor. The image forming unit forms images on sheets conveyed in sequence. The writing unit writes information in a wireless tag of a sheet, on which an image is formed by the image forming unit. The processor controls image-formation by the image forming unit to form a first image on a first sheet and to form a second image on a second sheet, the second image being next to the first image. The processor recognizes whether the writing unit succeeds in or does not succeed in writing the information in the wireless tag. The processor, when the processor recognizes that the writing unit does not succeed in writing the information in the wireless tag of the first sheet, on which the first image is formed, controls the image-formation by the image forming unit to form the first image again on a third sheet. Further, the processor controls conveyance of sheets to discharge the third sheet prior to the second sheet.

According to the embodiment, it is possible to provide an image forming apparatus, with which no page is skipped in discharged sheets and the page sequence is not disordered. Hereinafter, an image forming apparatus of an embodiment will be described with reference to the drawings. In the drawings, the same reference symbols indicate the same or similar hardware/software.

FIG. 1 is a side view showing the image forming apparatus 10 of the embodiment.

As shown in FIG. 1, the image forming apparatus 10 includes the control panel 13, the wireless tag unit 200, and the printer 18. The printer 18 includes the processor 51, the paper cassettes 16*a*, 16*b*, and the like. The processor 51 controls the control panel 13, the wireless tag unit 200, and the printer 18. The processor 51 controls conveyance of sheets in the printer 18. In the present embodiment, a wireless tag is, for example, an RF (Radio Frequency) tag.

The control panel 13 includes input keys and a display. For example, the input keys accept input from a user. For example, the display is a touchpanel-type display. The display accepts input from a user, and displays information for the user.

The paper cassette 16*a* accommodates sheets with wireless tags (hereinafter referred to as "wireless tag sheet".). The paper cassette 16*b* accommodates normal sheets without wireless tags (hereinafter referred to as "normal sheet".). Each of the paper cassettes 16*a*, 16*b* includes, for example, a cassette that accommodates sheets, and a paper-feeding mechanism. The paper-feeding mechanism feeds sheets of paper one by one from the cassette, and conveys the fed sheets to the conveying path 33*a*.

The printer 18 forms an image. For example, the printer forms an image on the basis of image data. In the following description, to form image is also referred to as printing. The printer 18 includes the intermediate transfer belt 21. The driven roller 41, the backup roller 40, and the like of the printer 18 support the intermediate transfer belt 21. The printer 18 rotates the intermediate transfer belt 21 in the direction of the arrow "m".

The printer 18 includes the four image forming stations 22Y, 22M, 22C, and 22K. The image forming stations 22Y, 22M, 22C, and 22K form images of Y (yellow), M (magenta), C (cyan), and K (black), respectively. The image forming stations 22Y, 22M, 22C, and 22K are arrayed side by side in the rotation direction of the intermediate transfer belt 21 below the intermediate transfer belt 21.

Hereinafter, for an example, the image forming station 22Y for Y (yellow) will be described out of the image forming stations 22Y, 22M, 22C, and 22K. Note that the structure of each of the image forming stations 22M, 22C, and 22K is similar to the structure of the image forming station 22Y, and therefore will not be described in detail.

The image forming station 22Y includes the electrostatic charger 26, the exposure scanning head 27, the developing device 28, and the photosensitive cleaner 29. The electrostatic charger 26, the exposure scanning head 27, the developing device 28, and the photosensitive cleaner 29 are arranged around the photosensitive drum 24, which rotates in the direction of the arrow "n".

The image forming station 22Y includes the primary transfer roller 30. The primary transfer roller 30 faces the photosensitive drum 24, the intermediate transfer belt 21 being therebetween.

In the image forming station 22Y, the electrostatic charger 26 electrostatically-charges the photosensitive drum 24, and then the exposure scanning head 27 exposes the photosensitive drum 24 to light. In the image forming station 22Y, an electrostatic latent image is formed on the photosensitive drum 24. The developing device 28 develops the electrostatic latent image on the photosensitive drum 24 with two-component developer including toner and carrier to thereby form a toner image on the photosensitive drum 24.

The primary transfer roller 30 primarily transfers the toner image formed on the photosensitive drum 24 to the intermediate transfer belt 21. In the image forming stations 22Y, 22M, 22C, and 22K, the primary transfer rollers 30 form a color toner image on the intermediate transfer belt 21. The color toner image is formed by overlaying a Y (yellow) toner image, a M (magenta) toner image, a C (cyan) toner image, and a K (black) toner image in sequence. After the primary transfer, the photosensitive cleaner 29 removes the remaining toner from the photosensitive drum 24.

The printer 18 includes the secondary transfer roller 32. The secondary transfer roller 32 faces the backup roller 40, the intermediate transfer belt 21 being therebetween. The secondary transfer roller 32 secondarily transfers the full-color toner image on the intermediate transfer belt 21 to a sheet. In other words, the image forming unit including the image forming stations 22Y, 22M, 22C, and 22K, the primary transfer roller 30, the intermediate transfer belt 21, and the secondary transfer roller 32 forms the image on the sheet.

The printer 18 includes the plurality of conveying paths 33*a*, 33*b*, and 33*c*. The convey path 33*a* is a conveying path from the junction point 44*a* to the branch-off point 44*b*. The conveying path 33*b* is a conveying path passing through the duplex printer device 38, i.e., a conveying path from the branch-off point 44*b* to the junction point 44*a*. The conveying path 33*c* is a conveying path from the branch-off point 44*b* to the switcher unit 202 of the wireless tag unit 200. Each of the conveying paths 33*a* to 33*c* includes, for example, guide members that guide a sheet, a conveying roller that conveys the sheet, and a motor that drives a conveying roller.

The processor 51 controls conveyance of a sheet via the conveying paths 33*a* to 33*c* and conveyance of a sheet from the above-mentioned paper cassettes 16*a*, 16*b*. For example, the processor 51 conveys a sheet fed from the paper cassette 16*a* or 16*b* to the conveying path 33*a*, and controls the fixer device 34 to fix a toner image to thereby fix an image on a sheet. The processor 51 conveys the sheet, on which the image is formed, to the conveying path 33*c* to thereby discharge the sheet.

When the printer 18 executes duplex printing, the processor 51 conveys a sheet, an image being formed on its front face, to the conveying path 33*c*. After the whole sheet passes through the branch-off point 44*b*, the processor 51 conveys the sheet to the conveying path 33*b* (switchback). After that, the processor 51 conveys the sheet to the junction point 44*a* via the conveying path in the duplex printer device 38, and conveys the sheet to the conveying path 33*a*. Then the processor 51 controls the fixer device 34 to fix a toner image to thereby form an image on the back face of the sheet. The processor 51 conveys the sheet, the image being formed on its back face, to the conveying path 33*c* to thereby discharge the sheet.

In the present example, the conveying path 33*b* is also used as a conveying path for evacuating a sheet. Specifically, the processor 51 firstly conveys a sheet, an image being formed on its front face, to the conveying path 33*c*. After the whole sheet passes through the branch-off point 44*b*, the processor 51 conveys the sheet to the conveying path 33*b* (switchback), and conveys the sheet until the whole sheet passes through the branch-off point 44*b*. As a result, the sheet is evacuated from the conveying path 33*a*, and the processor 51 is thus capable of conveying another sheet from the conveying path 33*a* to the conveying path 33*c*. When discharging the evacuated sheet, different from the way of duplex printing, the processor 51 conveys the sheet to the branch-off point 44*b*, and then conveys the sheet straight to the conveying path 33*c* to thereby discharge the sheet. In the following description, "normal conveyance" means to convey a sheet, on which an image is formed, from the conveying path 33*a* to the conveying path 33*c* without evacuating the sheet. Further, "evacuation conveyance" means to convey a sheet, on which an image is formed, for evacuating the sheet.

The wireless tag unit 200 includes the control unit 201, the switcher unit 202, the reading unit 203, and the writing unit 204. In the present example, the wireless tag unit 200 is detachable from the printer 18.

The control unit 201 includes a processing unit (processor unit) and a memory unit. The control unit 201 controls the reading unit 203 and the writing unit 204. Further, the control unit 201 controls the switcher unit 202 under control of the processor 51 that conveys a sheet. Further, the control unit 201 is capable of communicating with the processor 51. The control unit 201 is capable of detecting that a sheet is conveyed to the wireless tag unit 200.

The writing unit 204 writes information (hereinafter also referred to as "tag data") in a wireless tag of a wireless tag sheet on which an image is formed. The reading unit 203 reads the tag data from the wireless tag. The control unit 201 determines whether the writing unit 204 succeeds in or does not succeed in writing tag data on the basis of the tag data read from the wireless tag by the reading unit 203. When the control unit 201 determines that the writing unit 204 succeeds in writing tag data in a tag of a sheet, the switcher unit 202 discharges the sheet to the OK tray 20*a*. When the control unit 201 determines that the writing unit 204 does not succeed in writing tag data in a tag of a sheet, the switcher unit 202 discharges the sheet to the NG tray 20*b*. Note that all the normal sheets are discharged to the OK tray 20*a* after printing.

The above-mentioned image forming apparatus 10 is not limited to the so-called tandem type image forming unit. For example, the image forming unit may form toner images of respective colors on one photosensitive drum, and the toner images may be transferred directly from the photosensitive drum 24 to a sheet. Further, the number of the developing devices 28 of the image forming unit is not limited.

Figure 2:
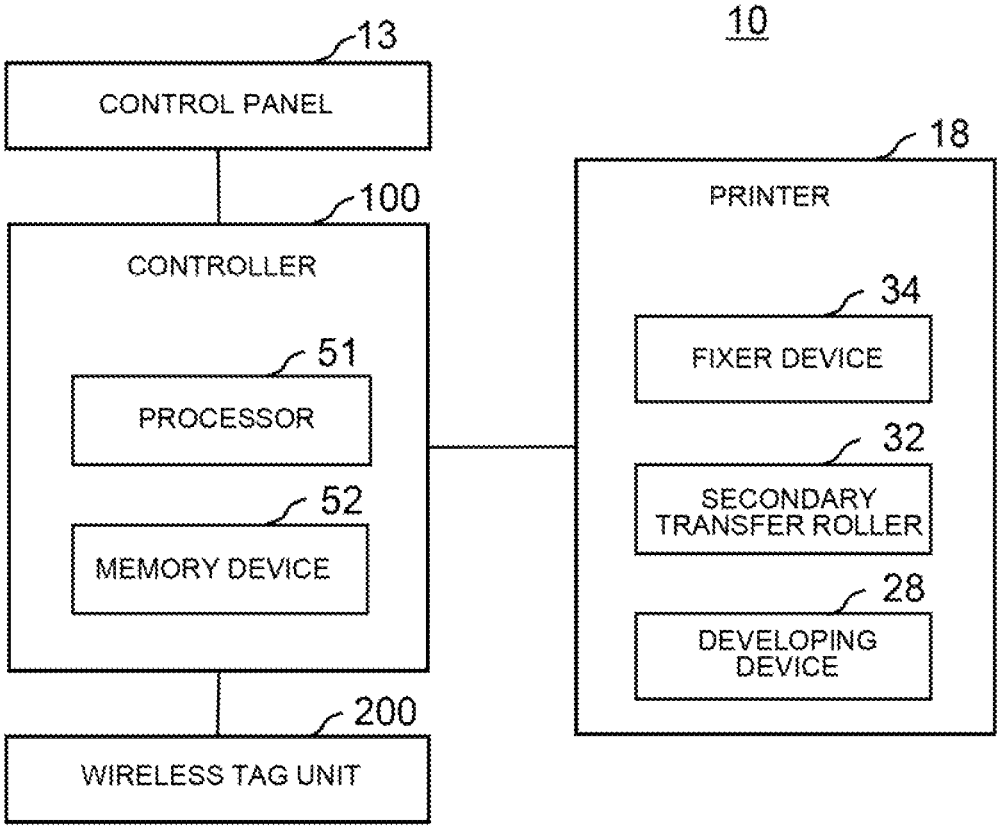
FIG. 2 is a block diagram showing the image forming apparatus of the embodiment.

FIG. 2 is a functional block diagram showing the image forming apparatus 10. The image forming apparatus 10 includes the controller 100, the control panel 13, the printer 18, and the wireless tag unit 200. The controller 100 includes the processor 51 and the memory device 52. The processor 51 executes an image processing program stored in the memory device 52 to thereby control the control panel 13 and the wireless tag unit 200. Further, the processor 51 controls conveyance of sheets from the paper cassettes and conveyance of sheets via the conveying paths 33*a*, 33*b*, and 33*c* depending on processing modes (described later). Further, the processor 51 controls the control unit 201 to thereby control the switcher unit 202 to discharge sheets.

The processor 51 is a computer device. The processor 51 includes, for example, a CPU (Central Processing Unit), an ASIC (Application Specific Integrated Circuit), and the like. The memory device 52 includes a ROM (Read Only Memory), a RAM (Random Access Memory), and the like.

As described above, the printer 18 includes the fixer device 34, the secondary transfer roller 32, and the developing device 28. Note that all or part of the functions of the image forming apparatus 10 may be realized by using hardware such as an ASIC, a PLD (Programmable Logic Device), and an FPGA (Field-Programmable Gate Array). The image processing program may be stored in a non-transitory computer readable recording medium. Examples of the non-transitory computer readable recording medium include memory devices such as a flexible disk, a magneto-optical disk, a ROM, a mobile medium such as a CD-ROM, and a hard disk built in a computer system. The image processing program may be sent via electronic communication lines.

In the present example, the image forming apparatus 10 (the processor 51) executes four processing modes of image forming process. According to one of the four processing modes, i.e., the normal printing mode, an image is formed on a normal sheet, or an image is formed on a wireless tag sheet but no tag data is written in a wireless tag. According to the other three processing modes, i.e., the sequence-nonguaranteed high-speed mode, the sequence-guaranteed low-speed mode, and the sequence-guaranteed high-speed mode, an image is formed on a wireless tag sheet and tag data is written in a wireless tag.

According to the sequence-nonguaranteed high-speed mode, even if the printer fails to write tag data in a wireless tag, re-printing (described later) is not executed. Therefore, for example, if the printer 18 prints images of 10 pages on sheets and fails to write tag data in a wireless tag on the 5th-page sheet, the sheets, on which images of 1st to 4th and 6th to 10th pages are printed, are stacked on the OK tray 20*a*.

As described above, according to the sequence-nonguaranteed high-speed mode, sequence of pages are nonguaranteed, but printing can be executed at a high speed since sequence-guaranteed page control is not executed.

According to the sequence-guaranteed low-speed mode and the sequence-guaranteed high-speed mode, sequence of pages are guaranteed but the printing speed is different. The above-mentioned four processing modes are selected by using the control panel 13 or the like. The processor 51 stores the selected processing mode in the memory device 52. Hereinafter, the image forming process of the present example will be described with reference to the flowcharts.

Figure 3:
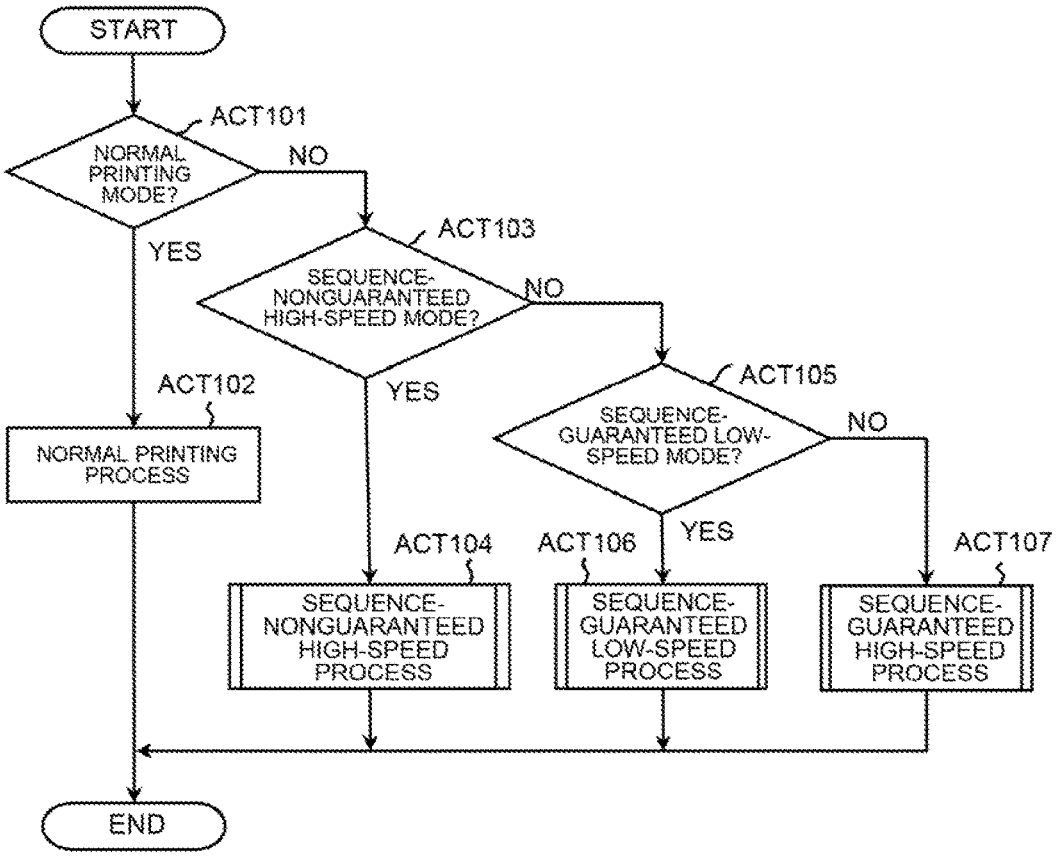
FIG. 3 is a flowchart showing the printing process of the image forming apparatus of the embodiment.

FIG. 3 is a flowchart showing the image forming process of the image forming apparatus 10. In FIG. 3, when the processor 51 starts the image forming process, the processor 51 determines whether selected processing mode is the normal printing mode or not with reference to the memory device 52 (ACT101). When the processing mode is the normal printing mode (ACT101: YES), the processor 51 executes the normal printing process (ACT102), and finishes this process. Since the normal printing process is a conventional process, description thereof will be omitted.

When the processing mode is not the normal printing mode (ACT101: NO), the processor 51 determines whether the selected processing mode is the sequence-nonguaranteed high-speed mode or not (ACT103). When the processing mode is the sequence-nonguaranteed high-speed mode (ACT102: YES), the processor 51 executes the sequence-nonguaranteed high-speed process (ACT104), and finishes this process. The sequence-nonguaranteed high-speed process will be described later in detail.

When the processing mode is not the sequence-nonguaranteed high-speed mode (ACT103: NO), the processor 51 determines whether the selected processing mode is the sequence-guaranteed low-speed mode or not (ACT105). When the processing mode is the sequence-guaranteed low-speed mode (ACT105: YES), the processor 51 executes the sequence-guaranteed low-speed process (ACT106), and finishes this process. The sequence-guaranteed low-speed process will be described later in detail.

When the processing mode is not the sequence-guaranteed low-speed mode (ACT105: NO), the processor 51 executes the sequence-guaranteed high-speed process (ACT107), and finishes this process. The sequence-guaranteed high-speed process will be described later in detail.

Figure 4:
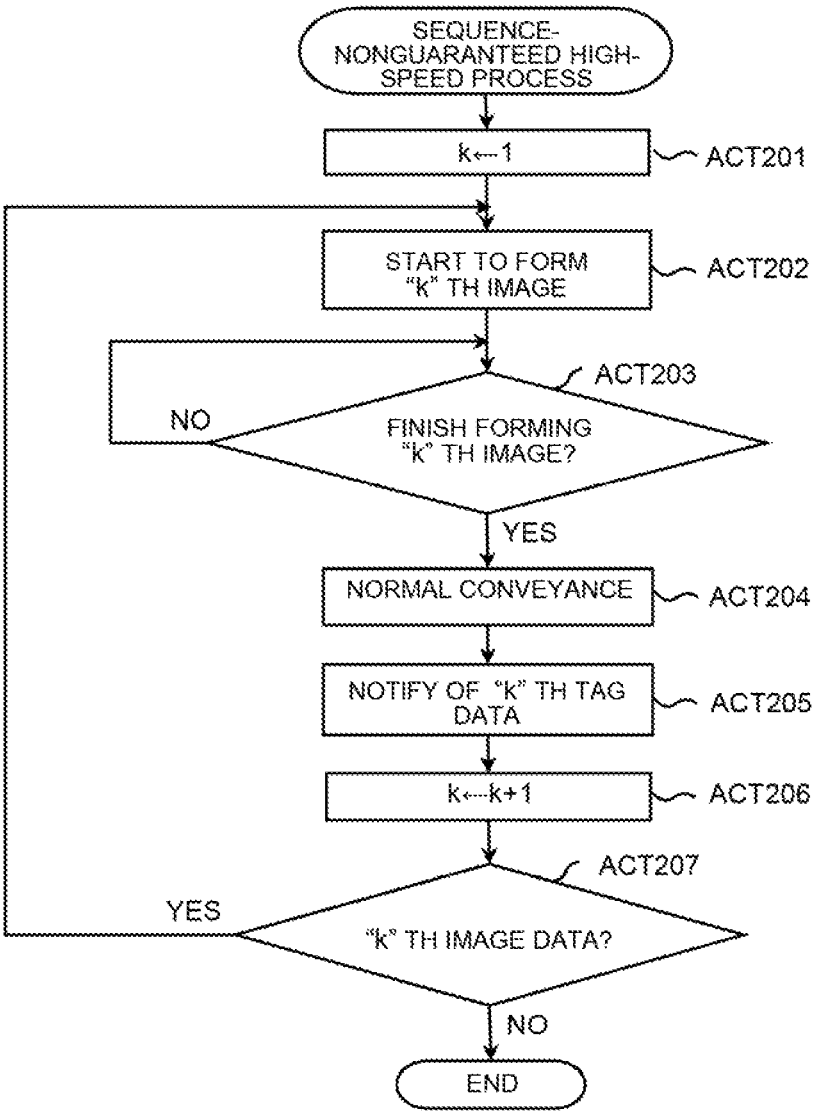
FIG. 4 is a flowchart showing the sequence-nonguaranteed high-speed process of the image forming apparatus of the embodiment.

FIG. 4 is a flowchart showing the flow of the sequence-nonguaranteed high-speed process. In FIG. 4, the processor 51 initializes the counter "k" for counting the page number, i.e., sets "1" (ACT201). The processor 51 starts to form an image of the "k"th page ("k"th image) (ACT202). When the processor 51 finishes forming the image of the "k"th page (ACT203: YES), the processor 51 conveys the sheet, on which the image is formed, in the normal way (ACT204).

The processor 51 notifies the wireless tag unit 200 of tag data to be written in the wireless tag of the "k"th-page sheet (ACT205). The processor 51 increments the counter "k" (ACT206). The processor 51 determines whether there is image data of the "k"th page or not (ACT207). When there is image data of the "k"th page (ACT207: YES), the processor 51 returns to ACT202. When there is no image data of the "k"th page (ACT207: NO), the processor 51 finishes this process.

In this way, according to the sequence-nonguaranteed high-speed mode, printing can be executed at a high speed since sequence-guaranteed page control is not executed.

Figure 5:
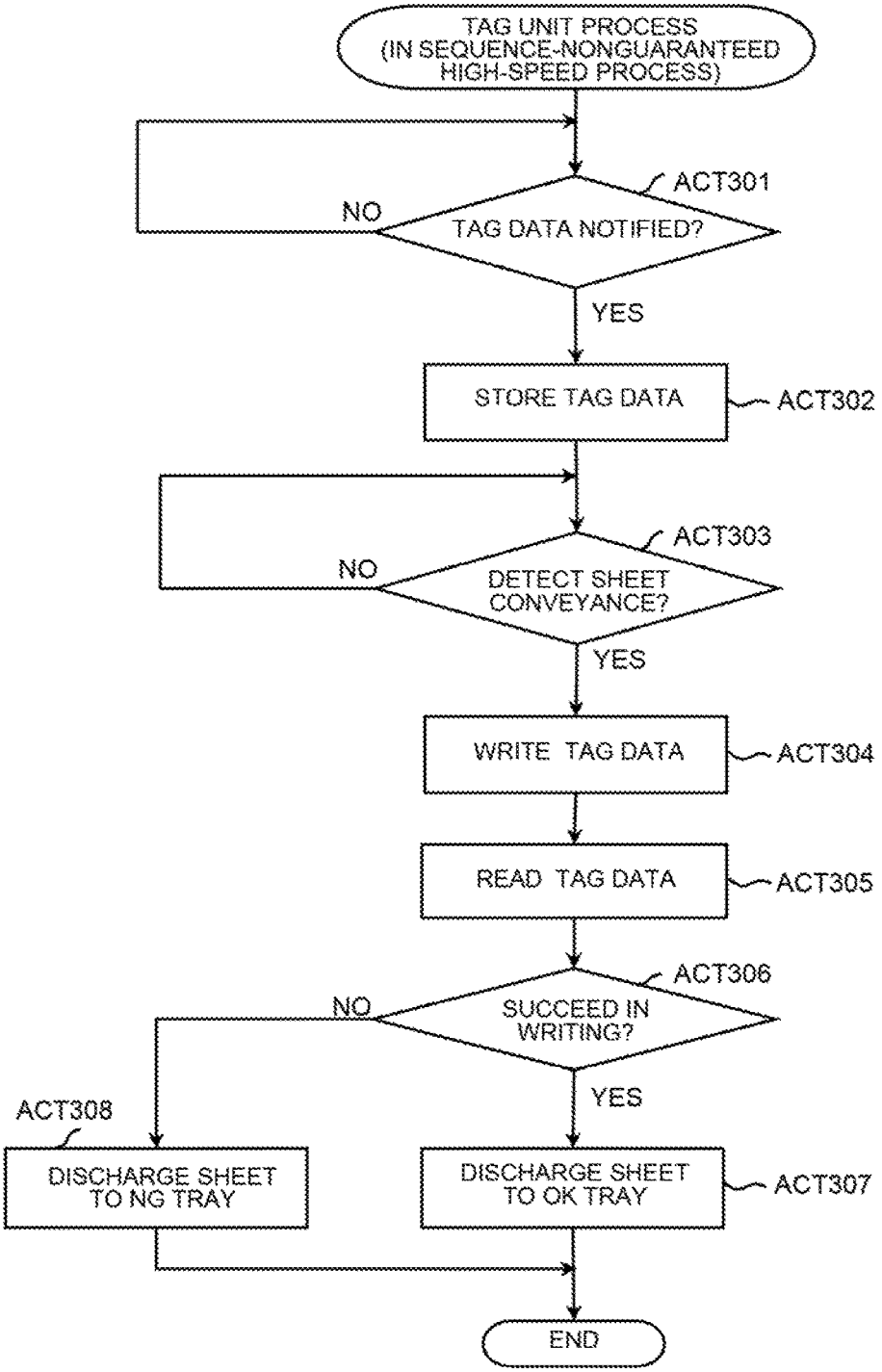
FIG. 5 is a flowchart showing the process executed by the wireless tag unit of the embodiment.

FIG. 5 is a flowchart showing the flow of the tag unit process executed by the wireless tag unit 200 in the sequence-nonguaranteed high-speed process. In FIG. 5, when the control unit 201 is notified of tag data (ACT301: YES), the control unit 201 stores the notified tag data in the memory unit (ACT302).

When the control unit 201 detects that a sheet is conveyed to the wireless tag unit 200 (ACT303: YES), the control unit 201 controls the writing unit 204 to write the stored tag data in the wireless tag (ACT304). The control unit 201 controls the reading unit 203 to read the tag data (ACT305).

The control unit 201 determines whether the writing unit 204 succeeds in or does not succeed in writing the tag data (ACT306). The control unit 201 determines that the writing unit 204 succeeds in writing the tag data when the tag data read by the reading unit 203 is the same as the stored tag data.

When the writing unit 204 succeeds in writing the tag data (ACT306: YES), the control unit 201 controls the switcher unit 202 to discharge the sheet to the OK tray 20*a* (ACT307), and finishes this process. When the writing unit 204 does not succeed in writing the tag data (ACT306: NO), the control unit 201 controls the switcher unit 202 to discharge the sheet to the NG tray 20*b* (ACT308), and finishes this process.

Figure 6:
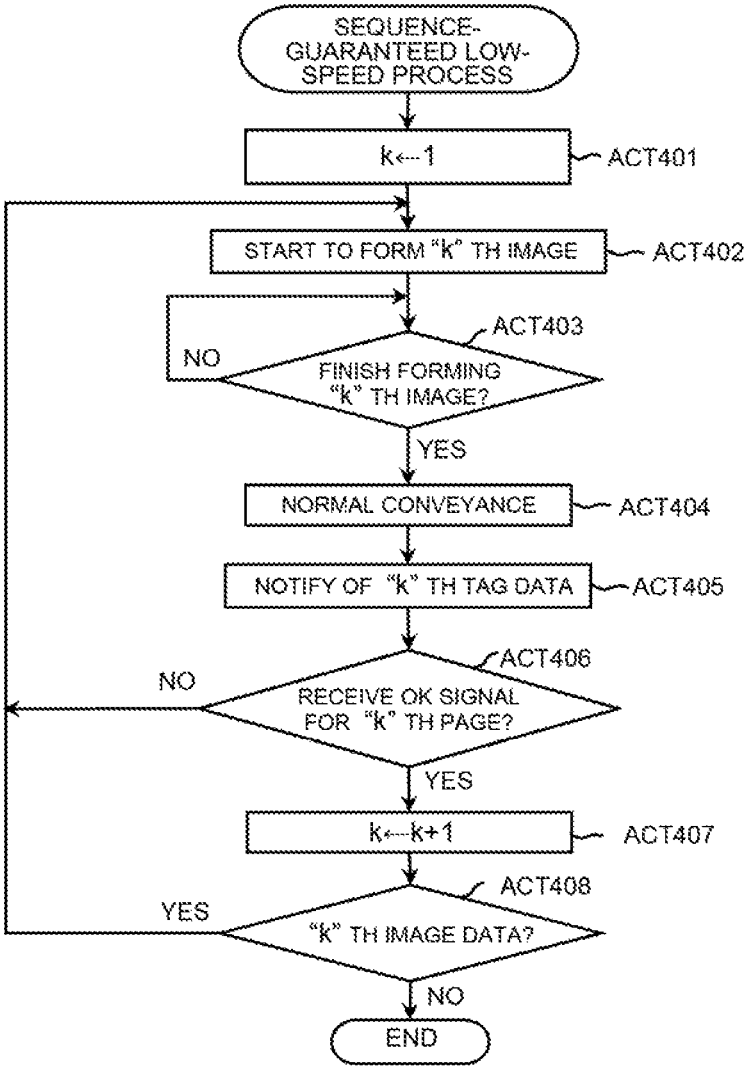
FIG. 6 is a flowchart showing the sequence-guaranteed low-speed process of the image forming apparatus of the embodiment.

FIG. 6 is a flowchart showing the flow of the sequence-guaranteed low-speed process. In FIG. 6, the processor 51 initializes the counter "k" for counting the page number, i.e., sets "1" (ACT401). The processor 51 starts to form an image of the "k"th page (ACT402). When the processor 51 finishes forming the image of the "k"th page (ACT403: YES), the processor 51 conveys the sheet, on which the image is formed, in the normal way (ACT404).

The processor 51 notifies the control unit 201 of tag data to be written in the wireless tag of the "k"th-page sheet (ACT405). At this time, the processor 51 notifies the control unit 201 that the tag data is the "k"th page, in addition to the tag data.

The processor 51 determines whether the processor 51 receives the OK signal (signal indicating that the writing unit 204 succeeds in writing tag data) for the "k"th-page sheet from the control unit 201 or not (ACT406). When the writing unit 204 succeeds in writing the tag data, the control unit 201 supplies the OK signal to the processor 51. When the writing unit 204 fails to write the tag data, the control unit 201 supplies an NG signal (signal indicating that the writing unit 204 fails to write tag data) to the processor 51.

When the processor 51 receives the NG signal from the control unit 201 (ACT406: NO), the processor 51 recognizes that the writing unit 204 does not succeed in writing the tag data, returns to ACT402, and starts to form an image of the "k"th page again (ACT402). When the processor 51 receives the OK signal from the control unit 201 (ACT406: YES), the processor 51 recognizes that the writing unit 204 succeeds in writing the tag data, and increments the counter "k" (ACT407).

The processor 51 determines whether there is image data of the "k"th page or not (ACT408). When there is image data of the "k"th page (ACT408: YES), the processor 51 returns to ACT402. When there is no image data of the "k"th page (ACT408: NO), the processor 51 finishes this process.

In this way, according to the sequence-guaranteed low-speed mode, when the control unit 201 determines that the writing unit 204 succeeds in writing tag data in a wireless tag of a sheet, on which a first image (image of "k"th page) is formed, a second image (image of "k+1"th page) is formed on a sheet.

The processor 51 executes the following process, when the control unit 201 determines that the writing unit 204 does not succeed in writing the tag data in the wireless tag of the sheet, on which the first image (image of "k"th page) is formed. In short, the processor 51 controls the printer 18 to form the first image (image of "k"th page) again on a new sheet (ACT402).

Only after the writing unit 204 succeeds in writing the tag data in the wireless tag of the sheet, on which the first image (image of "k"th page) is formed, the second image (image of "k+1"th page) is formed. Therefore the "k"th-page sheet is always discharged prior to the "k+1"th-page sheet. Therefore, according to the sequence-guaranteed low-speed mode, the sequence of the discharged sheets can be guaranteed, thus no page is skipped, and the page sequence is not disordered.

Figure 7:
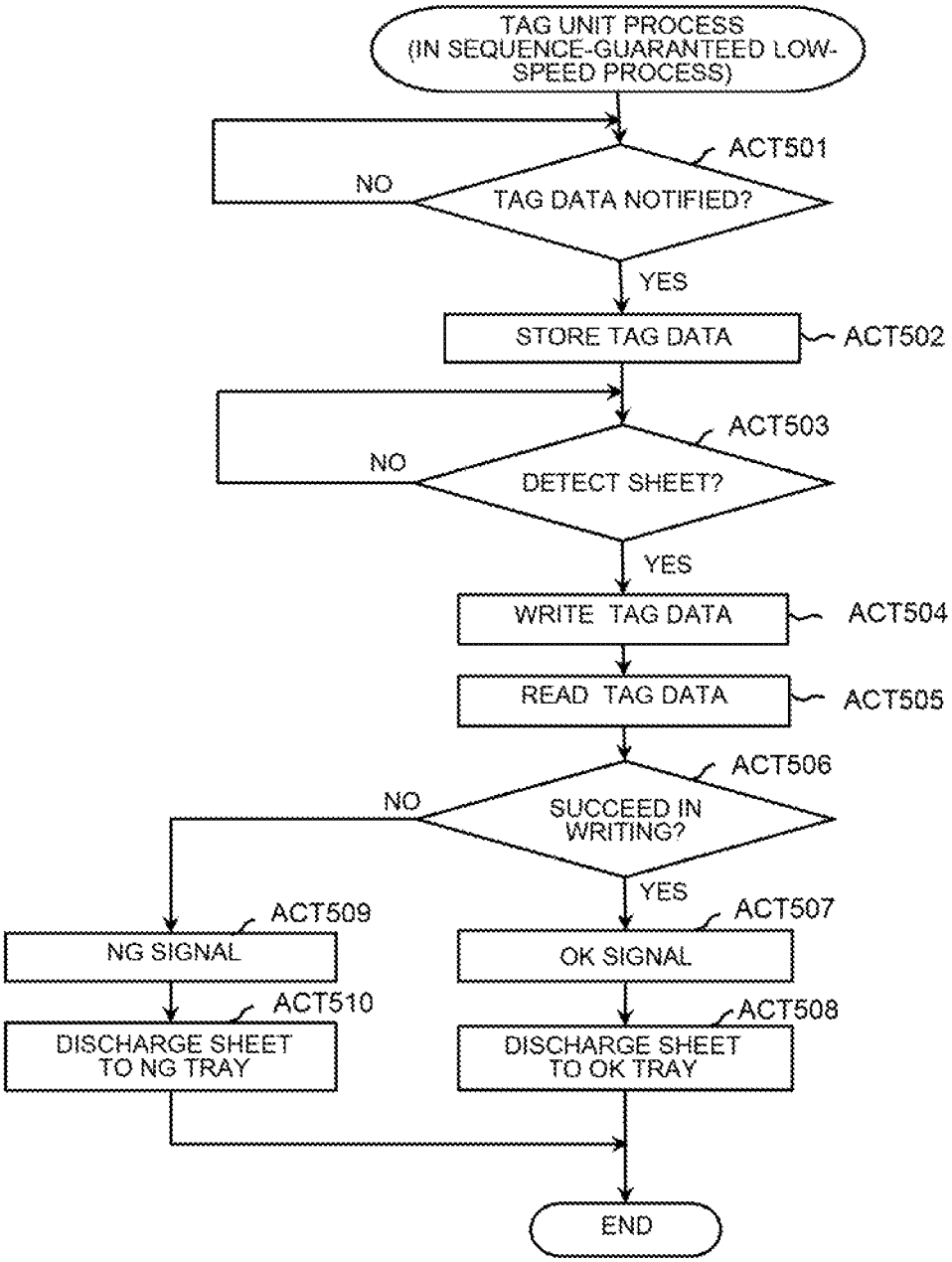
FIG. 7 is a flowchart showing the process executed by the wireless tag unit of the embodiment.

FIG. 7 is a flowchart showing the flow of the tag unit process executed by the wireless tag unit 200 in the sequence-guaranteed low-speed process. Note that the tag unit process of FIG. 7 is the same as the tag unit process executed by the wireless tag unit 200 in the sequence-guaranteed high-speed process (described later). Therefore, in FIG. 7, the sequence-guaranteed low-speed process and the sequence-guaranteed high-speed process will collectively be referred to as sequence-guaranteed process.

In FIG. 7, when the control unit 201 is notified of tag data (ACT501: YES), the control unit 201 stores the notified tag data in the memory unit (ACT502). Note that, as described above with reference to FIG. 6, the processor 51 notifies the control unit 201 that the tag data is the "k"th page, in addition to the tag data. So the control unit 201 stores the information indicating that the tag data is the "k"th page in the memory unit.

When the control unit 201 detects that a sheet is conveyed to the wireless tag unit 200 (ACT503: YES), the control unit 201 controls the writing unit 204 to write the stored tag data in the wireless tag (ACT504). The control unit 201 controls the reading unit 203 to read the tag data (ACT505).

The control unit 201 determines whether the writing unit 204 succeeds in or does not succeed in writing the tag data (ACT506). When the writing unit 204 succeeds in writing the tag data (ACT506: YES), the control unit 201 sends the OK signal to the processor 51. In other words, the control unit 201 notifies the processor 51 that the writing unit 204 succeeds in writing the tag data (ACT507). At this time, the control unit 201 notifies the processor 51 that the tag data, which the writing unit 204 succeeds in writing, is the "k"th page, in addition to the tag data. The control unit 201 controls the switcher unit 202 to discharge the sheet to the OK tray 20*a* (ACT508), and finishes this process.

When the writing unit 204 does not succeed in writing the tag data (ACT506: NO), the control unit 201 sends the NG signal to the processor 51. In other words, the control unit 201 notifies the processor 51 that the writing unit 204 does not succeed in writing the tag data (ACT509). At this time, the control unit 201 notifies the processor 51 that the tag data, which the writing unit 204 does not succeed in writing, is the "k"th page, in addition to the tag data. The control unit 201 controls the switcher unit 202 to discharge the sheet to the NG tray 20*b* (ACT510), and finishes this process.

Figure 8:
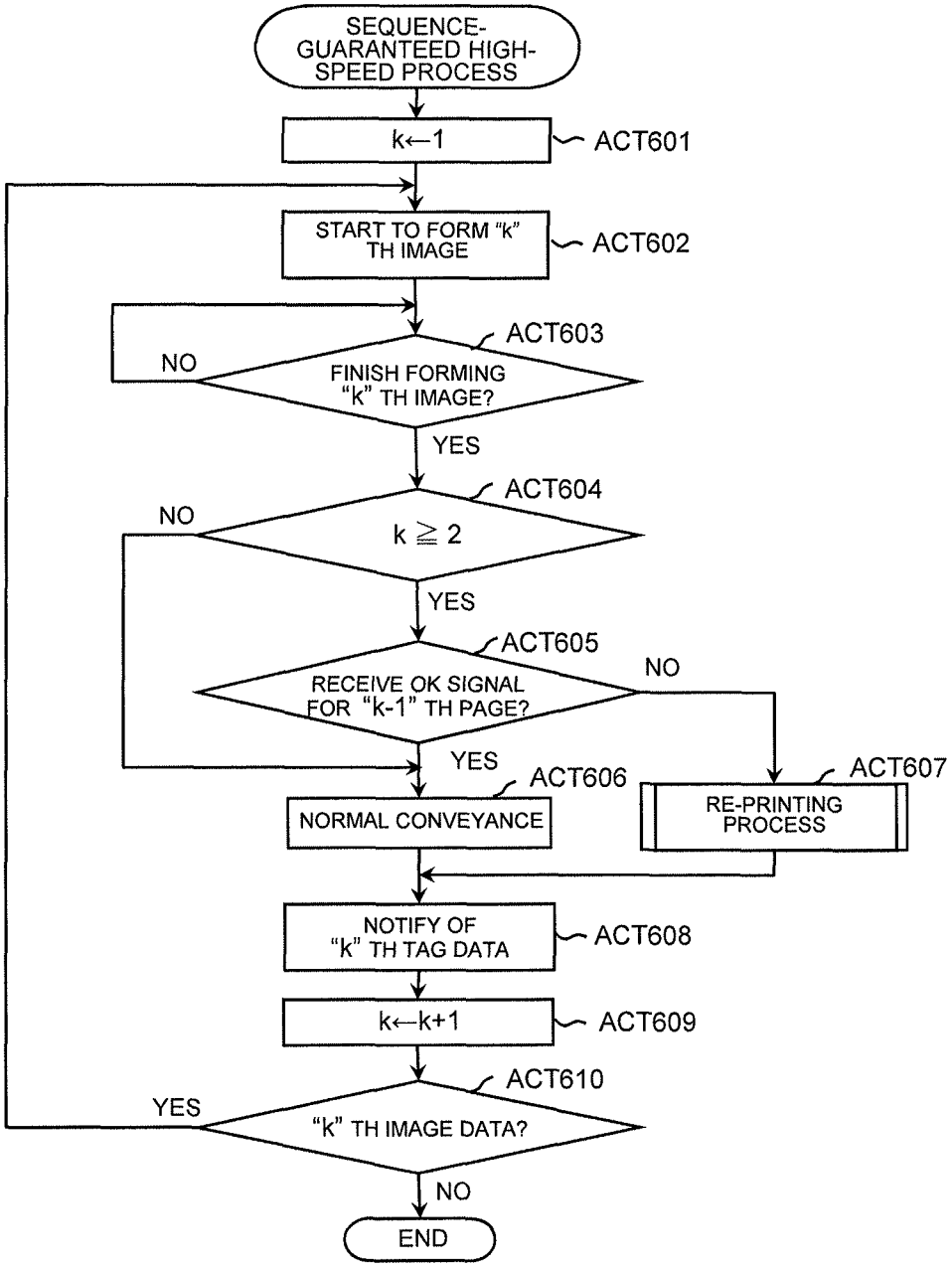
FIG. 8 is a flowchart showing the sequence-guaranteed high-speed process of the image forming apparatus of the embodiment.

FIG. 8 is a flowchart showing the flow of the sequence-guaranteed high-speed process. In FIG. 8, the processor 51 initializes the counter "k" for counting the page number, i.e., sets "1" (ACT601). The processor 51 starts to form an image of the "k"th page (ACT602). When the processor 51 finishes forming the image of the "k"th page (ACT603: YES), the processor 51 determines whether or not k is 2 or more (ACT604).

When k is less than 2 (ACT604: NO), the processor 51 proceeds to ACT606. When k is 2 or more (ACT604: YES), the processor 51 determines whether the processor 51 receives the OK signal for the "k−1"th page or not (ACT605). When the processor 51 receives the NG signal for the "k−1"th page (ACT605: NO), the processor 51 recognizes that the writing unit 204 does not succeed in writing the tag data, executes the re-printing process (described later) (ACT607), and proceeds to ACT608.

When the processor 51 receives the OK signal for the "k−1"th page (ACT605: YES), the processor 51 recognizes that the writing unit 204 succeeds in writing the tag data, and conveys the sheet, on which the image is formed, in the normal way (ACT606). The processor 51 notifies the control unit 201 of tag data to be written in the wireless tag of the "k"th-page sheet (ACT608). At this time, the processor 51 notifies the control unit 201 that the tag data is the "k"th page, in addition to the tag data.

The processor 51 increments the counter "k" (ACT609). The processor 51 determines whether there is image data of the "k"th page or not (ACT610). When there is image data of the "k"th page (ACT610: YES), the processor 51 returns to ACT602. When there is no image data of the "k"th page (ACT610: NO), the processor 51 finishes this process.

Figure 9:
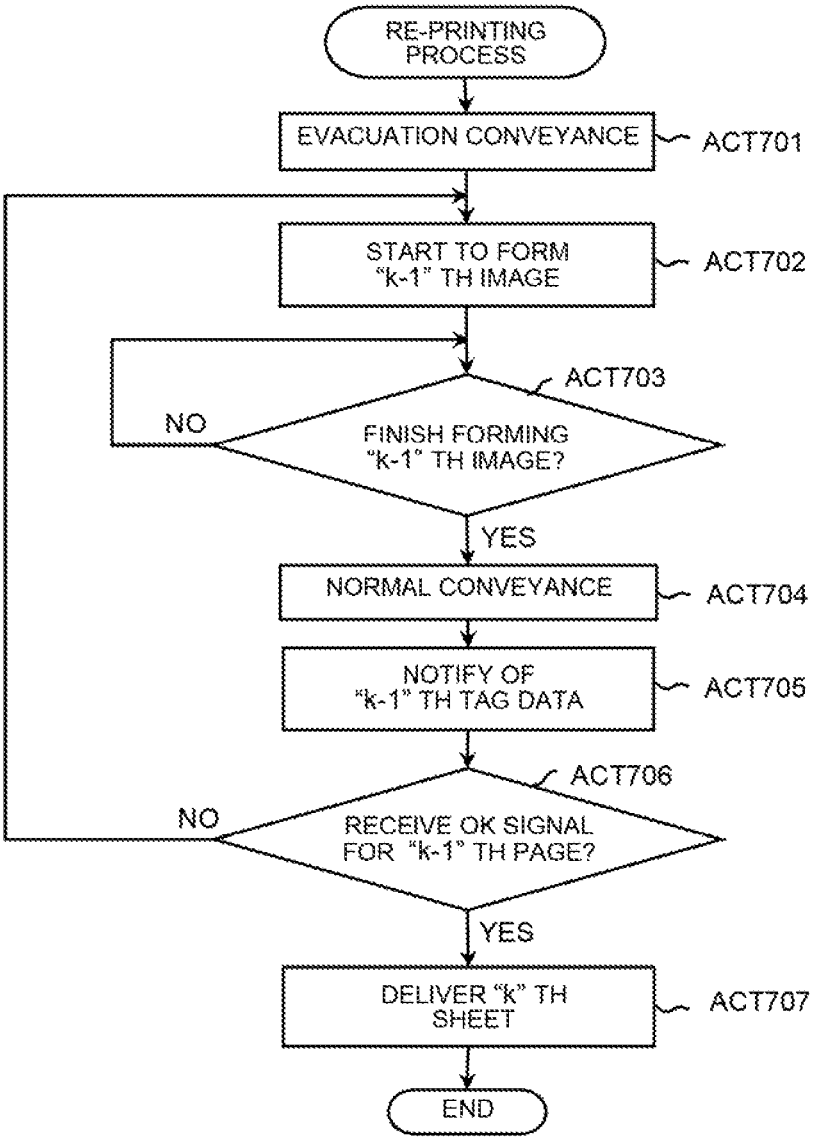
FIG. 9 is a flowchart showing the re-printing process of the image forming apparatus of the embodiment.

FIG. 9 is a flowchart showing the flow of the re-printing process. In FIG. 9, the processor 51 conveys the sheet, on which the image of the "k"th page is formed, for evacuation (ACT701). The processor 51 starts to form an image of the "k−1"th page (ACT702). When the processor 51 finishes forming the image of the "k−1"th page (ACT703: YES), the processor 51 conveys the sheet, on which the image is formed, in the normal way (ACT704). Since the sheet, on which the image of the "k"th page is formed, is conveyed for evacuation, the sheet, on which the image of the "k−1"th page is formed, can be conveyed to the wireless tag unit 200.

The processor 51 notifies the control unit 201 of tag data to be written in the wireless tag of the "k−1"th-page sheet (ACT705). At this time, the processor 51 notifies the control unit 201 that the tag data is the "k−1"th page, in addition to the tag data.

The processor 51 determines whether the processor 51 receives the OK signal for the "k−1"th page or not (ACT706). When the processor 51 receives the NG signal for the "k−1"th page (ACT706: NO), the processor 51 recognizes that the writing unit 204 does not succeed in writing the tag data, and returns to ACT702. When the processor 51 receives the OK signal for the "k−1"th page (ACT706: YES), the processor 51 recognizes that the writing unit 204 succeeds in writing the tag data, and conveys the evacuated sheet, on which the image of the "k"th page is formed, to the wireless tag unit 200 (ACT707).

In this manner, according to the sequence-guaranteed high-speed mode, before the control unit 201 determines whether the writing unit 204 succeeds in or does not succeed in writing tag data in the wireless tag of the sheet, on which the first image (image of "k−1"th page) is formed, the second image (image of "k"th page) is formed on a sheet in ACT602.

Then, when the control unit 201 determines that the writing unit 204 does not succeed in writing tag data in the wireless tag of the sheet, on which the first image (image of "k−1"th page) is formed, the following process is executed. In short, the processor 51 evacuates the sheet, on which the second image (image of "k"th page) is formed, from the conveying paths 33*a* and 33*c* for conveying the sheet from the printer 18 to the writing unit 204, to stay in the other conveying path 33*b* (ACT701).

When the control unit 201 determines that the writing unit 204 does not succeed in writing tag data in a tag of a sheet, then the processor 51 controls the printer 18 to form the first image (image of "k−1"th page), which is formed on the sheet, again on a new sheet (ACT702). The processor 51 conveys the sheet, on which the first image (image of "k−1"th page) is formed, in the normal way (ACT704). Only after the writing unit 204 succeeds in writing the tag data in the wireless tag of the thus-conveyed sheet, on which the first image (image of "k−1"th page) is formed, the evacuated sheet, on which the second image (image of "k"th page) is formed, is released. When the writing unit 204 succeeds in writing the tag data in the wireless tag of the sheet, on which the first image (image of "k−1"th page) is formed, the sheet, on which the second image (image of "k"th page) is formed, is conveyed to the wireless tag unit 200 (ACT707). Therefore the "k−1"th-page sheet is always discharged prior to the "k"th-page sheet.

Therefore, according to the sequence-guaranteed high-speed mode, the sequence of the discharged sheets can be guaranteed, thus no page is skipped, and the page sequence is not disordered. Further, according to the sequence-guaranteed high-speed mode, before the control unit 201 determines whether the writing unit 204 succeeds in or does not succeed in writing tag data in the wireless tag of the sheet, on which the first image (image of "k−1"th page) is formed, the second image (image of "k"th page) is formed on a sheet in ACT602. Therefore, the printing speed of the sequence-guaranteed high-speed mode is higher than the printing speed of the sequence-guaranteed low-speed mode.

In the above-mentioned embodiment, an ink-jet device may be provided in the wireless tag unit, and may print "NG", a slash, or the like on a sheet with a wireless tag, in which the writing unit 204 fails to write information (tag data), before discharging the sheet. In this case, the tray to which the sheet is discharged may be the same as the tray to which a sheet with a wireless tag, in which the writing unit 204 succeeds in writing information, is discharged.

Data can be read from/written in some types of wireless tags from several meters away. Therefore it is not necessary to provide a reading unit and a writing unit close to a sheet as described in the present example. For example, a reading unit and a writing unit may be provided several meters away. Further, the writing unit writes information (tag data) in a wireless tag of a sheet, on which an image is formed, the reading unit reads the information from the wireless tag, and the control unit determines whether the writing unit succeeds in or does not succeed in writing the information in the wireless tag. The control unit may send the result of the determination to the switcher unit via wireless communication.

According to the image forming apparatus of the above-mentioned embodiment, it is possible to provide an image forming apparatus, with which no page is skipped and the page sequence is not disordered.

A computer may realize the functions of the image forming apparatus of the above-mentioned embodiment. In this case, a non-transitory computer readable recording medium may store a program for realizing those functions, and a computer system may read the program stored in the recording medium and execute the program to thereby realize those functions. Note that, herein, the "computer system" includes an OS and hardware such as peripheral devices. Further, the "non-transitory computer readable recording medium" means a flexible disk, a magneto-optical disk, a ROM, a mobile medium such as a CD-ROM, a memory device such as a hard disk built in the computer system. Further, the "non-transitory computer readable recording medium" may also mean a recording medium that stores the program instantly and dynamically, such as a communication line, when the program is sent via a network such as the Internet or a communication line such as a telephone line. In this case, the "non-transitory computer readable recording medium" may also mean a recording medium that stores the program for a predetermined time period, such as a volatile memory in a computer system such as a server or a client. Further, the above-mentioned program may realize part of the above-mentioned functions, and may realize the above-mentioned functions on the basis of combination with a program already recorded in the computer system.

While certain the embodiments have been described, these the embodiments have been presented by way of example only, and are not intended to limit the scope of the inventions. Indeed, the novel the embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

an image forming unit that forms images with a toner on sheets conveyed in sequence;

a fixer device that fixes the formed image on a sheet;

a writing unit that writes information in a wireless tag of a sheet, on which an image is fixed by the fixer device; and a first processor that determines whether the writing unit succeeds in or does not succeed in writing the information in the wireless tag and outputs a result of the determination;

a first tray;

a second tray;

a control panel that accepts a setting of one of a first mode on which a sheet conveyance order is guaranteed and a second mode on which the sheet conveyance order is not guaranteed; and a second processor that:

in a case where the control panel accepts the setting of the first mode, controls the image formation by the image forming unit to form a first image on a first sheet, and in a case of receiving the determination result, outputted by the first processor, determining that the writing unit succeeds in writing the information in the wireless tag of the first sheet, controls the image-formation by the image forming unit to form a second image on a second sheet, the second image being next to the first image, in a case where the control panel accepts the setting of the second mode, controls the image-formation by the image forming unit to form a first image on a first sheet and controls the image-formation by the image forming unit to form a second image on the second sheet without receiving the determination result, outputted by the first processor, determining that the writing unit succeeds in writing the information in the wireless tag of the first sheet, and in a case of receiving the determination result, outputted by the first processor, determining that the writing unit succeeds in writing the information in the wireless tag of the first sheet, controls conveyance of sheets to discharge the first sheet to the first tray, and in a case of receiving the determination result, outputted by the first processor, determining that the writing unit does not succeed in writing the information in the wireless tag of the first sheet, controls conveyance of sheets to discharge the first sheet to the second tray.

2. The image forming apparatus according to claim 1, wherein:

in the case of receiving the determination result, outputted by the first processor, determining that the writing unit does not succeed in writing the information in the wireless tag of the first sheet, the second processor controls the image-formation by the image forming unit to form the first image again on a third sheet, and the second processor controls the conveyance of sheets to discharge the third sheet prior to the second sheet.

3. The image forming apparatus according to claim 2, wherein:

the second sheet is a sheet conveyed next to the first sheet, and the third sheet is a sheet conveyed next to the second sheet.

4. The image forming apparatus according to claim 2, wherein:

the third sheet is a sheet conveyed next to the first sheet, and the second sheet is a sheet conveyed next to the third sheet.

5. The image forming apparatus according to claim 4, wherein:

the second processor controls the image-formation by the image forming unit to form the second image on the second sheet, in a case of receiving the determination result, outputted by the first processor, determining that the writing unit succeeds in writing the information in the wireless tag of the third sheet on which the first image is formed again.

6. The image forming apparatus according to claim 2, wherein:

in the case of receiving the determination result, outputted by the first processor, determining that the writing unit succeeds in writing the information in the wireless tag of the first sheet, the second processor controls the image-formation by the image forming unit not to form the first image again, and the second processor controls the conveyance of sheets to discharge the first sheet prior to the second sheet.

7. The image forming apparatus according to claim 1, wherein:

the second processor controls the image formation by the image forming unit to form the second image on the second sheet, before receiving the determination result, outputted by the first processor, determining that the writing unit succeeds in writing the information in the wireless tag of the first sheet.

8. The image forming apparatus according to claim 1, wherein:

the second processor controls the image formation by the image forming unit to form images on the sheets in sequence without receiving the determination outputted by the first processor, in a case where the writing unit writes no information in the wireless tag.

9. The image forming apparatus according to claim 1, further comprising:

a wireless tag unit detachable from the image forming apparatus, wherein the wireless tag unit includes the writing unit and the first processor.

10. An image forming method for an image forming apparatus having an image forming unit that forms images on sheets conveyed in sequence with a toner, a fixer device that fixes the formed image on a sheet, a writing unit that writes information in a wireless tag of a sheet, on which an image is fixed by the fixer device, a processor that determines whether the writing unit succeeds in or does not succeed in writing the information in the wireless tag and outputs a result of the determination, and a control panel that accepts setting of one of a first mode on which a sheet conveyance order is guaranteed and a second mode on which the sheet conveyance order is not guaranteed, the image forming method comprising:

in a case where the control panel accepts the setting of the first mode, controlling the image-formation by the image forming unit to form a first image on a first sheet, and in a case of receiving the determination result, outputted by the processor, determining that the writing unit succeeds in writing the information in the wireless tag of the second sheet, controlling the image-formation by the image forming unit to form a second image on a second sheet, the second image being next to the first image, in a case where the control panel accepts the setting of the second mode, controlling the image-formation by the image forming unit to form a first image on a first sheet and controlling the image-formation by the image forming unit to form a second image on the second sheet without receiving the determination result, outputted by the processor, determining that the writing unit succeeds in writing the information in the wireless tag of the first sheet, and in a case of receiving the determination result, outputted by the processor, determining that the writing unit succeeds in writing the information in the wireless tag of the first sheet, controlling conveyance of sheets to discharge the first sheet to the first tray, and in a case of receiving the determination result, outputted by the processor, determining that the writing unit does not succeed in writing the information in the wireless tag of the first sheet, controlling conveyance of sheets to discharge the first sheet to the second tray.

* * * * *